US005683860A

United States Patent [19]

Diehl et al.

[11] Patent Number: 5,683,860

[45] Date of Patent: Nov. 4, 1997

[54] SILVER HALIDE LIGHT-SENSITIVE ELEMENT

[75] Inventors: Donald R. Diehl; Linda J. Beattie, both of Rochester; Gary N. Barber, Penfield, all of N.Y.

[73] Assignee: Eastman Kodak Company, Rochester, N.Y.

[21] Appl. No.: 768,544

[22] Filed: Dec. 18, 1996

[51] Int. Cl.[6] ..... G03C 1/40; G03C 1/83

[52] U.S. Cl. ..... 430/507; 430/517; 430/519; 430/522; 430/591

[58] Field of Search ..... 430/507, 517, 430/522, 591, 519

[56] References Cited

U.S. PATENT DOCUMENTS

| | | | |
|---|---|---|---|
| 2,865,752 | 12/1958 | Saunders et al. . | |
| 3,575,704 | 4/1971 | Salesin . | |
| 4,746,600 | 5/1988 | Watanabe et al. | 430/223 |
| 4,855,220 | 8/1989 | Szajewski | 430/223 |
| 4,940,654 | 7/1990 | Diehl et al. | 430/522 |
| 4,956,269 | 9/1990 | Ikeda et al. | 430/522 |
| 5,395,744 | 3/1995 | Sowinski et al. | 430/521 |
| 5,451,494 | 9/1995 | Diehl et al. | 430/522 |

FOREIGN PATENT DOCUMENTS 510960 10/1992 European Pat. Off. .

OTHER PUBLICATIONS

*Dyes and Pigments*, vol. 6 (1985), A.T.Peters , Ed., pp. 135–154, "Synthesis and Purification of Trisulphoindigo and Reversed–Phase High Performance Liquid Chromatographic Determination of Trisulphoindigo in FD&C Blue No.2", J.E.Bailey, Jr. and J.Travis.

*Primary Examiner*—Richard L. Schilling

*Attorney, Agent, or Firm*—Andrew J. Anderson

[57] ABSTRACT

A silver halide light sensitive photographic element comprising a support bearing on one side thereof at least one light-sensitive silver halide emulsion layer, wherein the emulsion layer or a separate hydrophilic colloid layer of the element comprises a soluble absorber dye of the following formula (I):

(I)

wherein each M is H or a counterion; each $R^1$ and $R^2$ independently represents H or a photographically acceptable substituent; m+p equals from 1 to 4; n+q equals from 1 to 4; and each of r and t represents from 0 to 3. In preferred embodiments of the invention, the element comprises at least one red-sensitive silver halide emulsion layer, and a dye of formula (I) is coated on the same side of the support as the red-sensitive emulsion layer. In particularly preferred embodiments, the element comprises a support bearing on the same side at least one blue-sensitive silver halide emulsion yellow-image forming layer, at least one red-sensitive silver halide emulsion cyan-image forming layer, at least one green-sensitive silver halide emulsion magenta-image forming layer, and a dye of the formula (I) is coated in at least one of the emulsion layers or a separate hydrophilic colloid layer on the same side of the support. Dyes of formula (I) typically provide substantial absorption at short red wavelengths below about 630 nm, and photographic elements in accordance with the invention accordingly exhibit effective safelight performance for commonly used safelights emitting in the range of 560–630 nm, such as those using a Kodak Safelight Filter No. 8.

14 Claims, No Drawings

SILVER HALIDE LIGHT-SENSITIVE ELEMENT

TECHNICAL FIELD

This invention relates generally to the field of silver halide light sensitive elements, and in particular to such elements comprising a soluble indigo dye. In a particular aspect it relates to motion picture print films.

BACKGROUND OF THE INVENTION

Soluble absorber dyes have traditionally been incorporated into hydrophilic colloid layers of photographic elements to provide or assist in providing various features such as silver halide emulsion layer speed control, improved image sharpness, antihalation protection, and safelight exposure protection. Soluble dyes may be coated directly in an emulsion layer or in a separate hydrophilic colloid layer, and in the absence of a mordant diffuse readily from one layer to the next on the same side of the support. Depending upon their desired function, absorbers dyes may be used which absorb light over narrow or relatively wide wavelength ranges. Anthraquinone absorbing dye D-1, for example, which absorbs over a relatively wide red wavelength range (lambda max approx. 634 nm and half-band width approx. from 560–720 nm), has been used to help provide speed control, image sharpness, antihalation protection, and/or safelight protection for various silver halide photographic elements containing red-sensitized silver halide emulsions (see, e.g., U.S. Pat. Nos. 2,865,752, 3,575,704, 4,956,269).

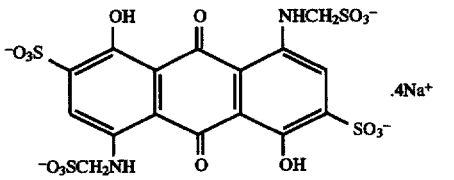

PROBLEMS TO BE SOLVED

One problem associated with many soluble absorber dyes incorporated into photographic elements is the undesirable interaction of the dyes with other components in the photographic system. Dyes may interact with other photographic components either before or during processing, such as with photographic couplers or with oxidized developer. Such interactions can alter the desired photographic activity of the dyes or couplers, and in some cases generate by-products resulting in deleterious stains in the element. Additionally, some absorber dyes, such as commonly used D-1, may demonstrate unwanted changes in its absorbance spectrum when subjected to high humidity conditions, resulting in undesired red speed changes in photographic elements containing such absorber dye. Further, many soluble absorber dyes including D-1 are not fully process bleachable (i.e., decolorized) in high sulfite photographic processing solutions, and accordingly may result in an accumulated dye sludge in such processing solutions. It has further been found that many absorber dyes do not provide adequate safelight protection for common safelights emitting in the range of 560–630 nm, such as those using a Kodak Safelight Filter No. 8.

SUMMARY OF THE INVENTION

It is an object of the invention to provide photographic elements comprising soluble absorber dyes which leave little or no deleterious stains in the element as a result of interaction with other components of the photographic element. It is a further object to provide photographic elements comprising such dyes which do not demonstrate unwanted changes in their absorbance spectrum when subjected to high humidity conditions so as to result in little or no red speed keeping changes. It is a further object to provide photographic elements comprising such dyes which are fully removed and decolorized upon photographic processing, and which do not adversely interact with other photographic components. It is a further object to provide effective safelight protection in photographic elements when using such dyes.

These and other objects are achieved in accordance with the invention, one embodiment of which comprises a silver halide light sensitive photographic element comprising a support bearing on one side thereof at least one light-sensitive silver halide emulsion layer, wherein the emulsion layer or a separate hydrophilic colloid layer of the element comprises a soluble absorber dye of the following formula (I):

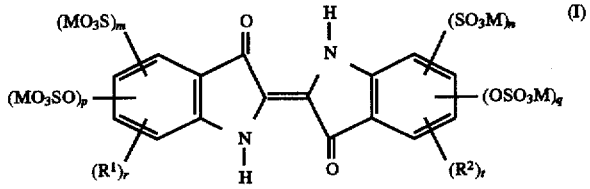

wherein each M is H or a counterion, such as Na, K, pyridinium, ammonium or substituted ammonium (e.g., trialkylammonium, triphenylammonium, etc.); each $R^1$ and $R^2$ independently represents H or a photographically acceptable substituent; m+p equals from 1 to 4; n+q equals from 1 to 4; and each of r and t represents from 0 to 3.

In preferred embodiments of the invention, the element comprises at least one red-sensitive silver halide emulsion layer, and a dye of formula (I) is coated on the same side of the support as the red-sensitive emulsion layer. In particularly preferred embodiments, the element comprises a support bearing on the same side at least one blue-sensitive silver halide emulsion yellow-image forming layer, at least one red-sensitive silver halide emulsion cyan-image forming layer, at least one green-sensitive silver halide emulsion magenta-image forming layer, and a dye of the formula (I) is coated in at least one of the emulsion layers or a separate hydrophilic colloid layer on the same side of the support.

ADVANTAGES

Dyes of formula (I) typically provide substantial absorption at short red wavelengths below about 630 nm, and photographic elements in accordance with the invention accordingly exhibit effective safelight performance for commonly used safelights emitting in the range of 560–630 nm, such as those using a Kodak Safelight Filter No. 8. Additionally, the absorber dyes used in accordance with the invention do not demonstrate unwanted changes in their absorbance spectrum when subjected to high humidity conditions so as to result in little or no red speed keeping changes. Further, the absorber dyes are fully decolorized in high sulfite photographic processing solutions. Additionally, the absorber dyes do not undesirably interact with other components in the photographic system.

DETAILED DESCRIPTION

Photographic elements of the invention can be black-and-white or single color elements, but preferably are multicolor elements. Multicolor elements typically contain image dye-forming units sensitive to each of the three primary regions of the visible spectrum, i.e. blue (about 400 to 500 nm), green (about 500 to 600 nm), and red (about 600 to 760 nm) sensitive image dye-forming units. Each unit can comprise a single emulsion layer or multiple emulsion layers sensitive to a given region of the spectrum. The layers of the element, including the layers of the image-forming units, can be arranged in various orders as known in the art. The invention is particularly applicable to photographic print elements designed for exposure though a negative film and projection display, such as motion picture print and intermediate films.

Photographic elements of the invention comprise soluble absorber dyes of formula (I), preferably located on the same side of the element support as the emulsion layers to provide emulsion side safelight exposure protection. The dyes may also be located in a layer on the side of the support opposite to the emulsion layers to provide backside safelight exposure protection and/or antihalation protection, either alone or in combination with other absorbing dyes. Depending upon the layer arrangement and sensitivities of the various layers of the element, additional absorber dyes may be incorporated in the same layer as the dye of formula (I), and/or may be incorporated into separate layers. For example, where the element comprises a support bearing in order separate blue-sensitive, red-sensitive, and green-sensitive silver halide layers coated thereon (which is a preferred arrangement for motion picture color print films), the dyes of formula (I) are preferably used in combination with additional soluble blue, green and/or red absorbing dyes in order to provide speed control and antihalation protection for the various layers.

The soluble absorber dyes of formula (I) represent water-soluble derivatives of indigo dye comprising at least two sulfo or sulfato substituents (i.e., each of m+p and n+q in formula (I) represent at least 1), along with any additional photographically acceptable substituent. For example, each $R^1$ and $R^2$ may independently be one or more photographically acceptable substitutents selected from an alkyl group, an aryl group, a heterocyclic group, an alkoxy group (for example, methoxy, 2-methoxyethoxy), an aryloxy group (for example, 2,4-di-tert-amylphenoxy, 2-chlorophenoxy, 4-cyanophenoxy), an alkenyloxy group (for example, 2-propenyloxy), an acyl group (for example, acetyl, benzoyl), an ester group (for example, butoxycarbonyl, phenoxycarbonyl, acetoxy, benzoyloxy, butoxysulfonyl, toluenesulfonyloxy), an amido group (for example, acetylamino, methanesulfonamido, dipropylsulfamoylamino), a carbamoyl group (for example, dimethylcarbamoyl, ethylcarbamoyl), a sulfamoyl group (for example, butylsulfamoyl), an imido group (for example, succinimido, hydantoinyl), a ureido group (for example, phenylureido, dimethylureido), an aliphatic or aromatic sulfonyl group (for example, methanesulfonyl, phenylsulfonyl), an aliphatic or aromatic thio group (for example, ethylthio, phenylthio), a hydroxy group, a cyano group, a carboxy group, a nitro group, a sulfo group, and a halogen atom.

Soluble absorber dyes of formula I are commercially available, and typical uses include use as a food and drug colorant. The dyes may be synthesized according to known processes, such as described in *Dyes and Pigments*, Vol. 6 (1985), A. T. Peters, Ed., pp.135–54, "Synthesis and Purification of Trisulphoindigo and Reversed-Phase High Performance Liquid Chromatographic Determination of Trisulphoindigo in FD&C Blue No.2", J. E. Bailey, Jr. and J. Travis, the disclosure of which is incorporated by reference herein.

Preferred dyes in accordance with the invention include those wherein m+p+n+q equals from 2 to 6, more preferably 2–4, and most preferably 3. Such preferred dyes demonstrate optimized combined safelight protection and photographic process bleachability. Exemplary dyes in accordance with the invention include the following:

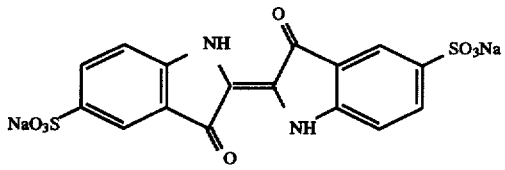

I-1

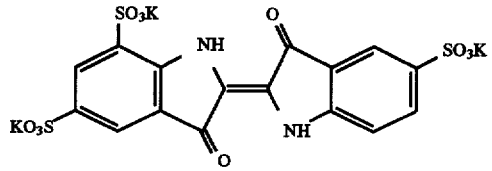

I-2

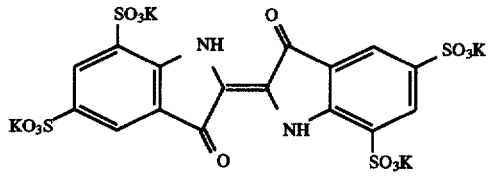

I-3

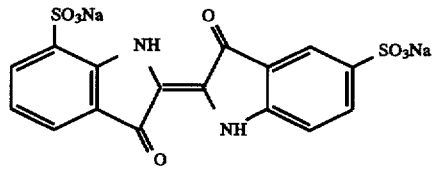

I-4

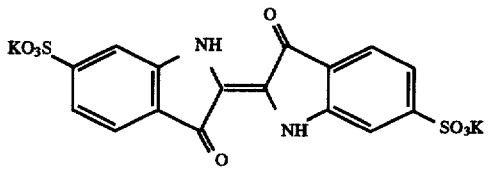

I-5

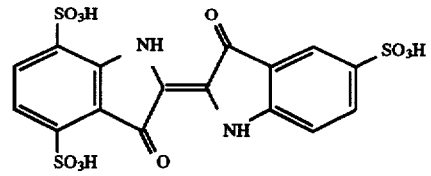

I-6

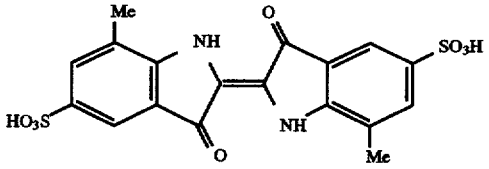

I-7

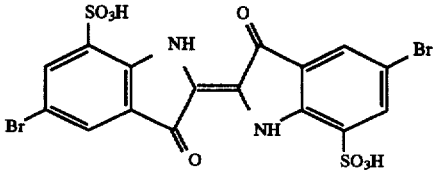

I-8

-continued

I-9

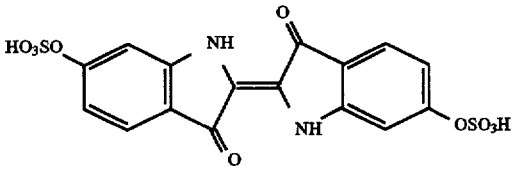

I-10

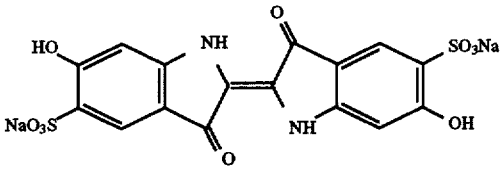

I-11

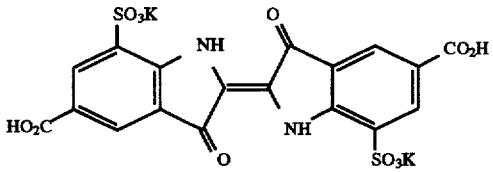

The soluble absorber dyes in accordance with the invention are incorporated into a light-sensitive silver halide emulsion hydrophilic colloid layer, or a separate hydrophilic colloid layer, such as a subbing, intermediate, or overcoat layer. The hydrophilic colloid of such layers is preferably gelatin. This may be any gelatin or modified gelatin such as acetylated gelatin, phthalated gelatin, oxidized gelatin, etc. Gelatin may be base-processed, such as lime-processed gelatin, or may be acid-processed, such as acid-processed ossein gelatin. The hydrophilic colloid may be another water-soluble polymer or copolymer or mixtures thereof with gelatin, including, but not limited to, poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic add), polyacrylamide. Copolymers of these polymers with hydrophobic monomers may also be used.

While absorber dyes of formula (I) may be used at coverages varying over wide ranges to provide varying effect, for desired levels of safelight protection while still enabling essentially complete removal upon photographic processing, the soluble absorber dyes of formula (I) are preferably incorporated into hydrophilic colloid layers in elements of the invention at coverages of from about 10–250 mg/m$^2$, more preferably about 20–130 mg/m$^2$.

In a preferred embodiment of the invention, the photographic element comprises at least one red-sensitive silver halide emulsion layer. In further preferred embodiments, the soluble absorber dyes of formula (I) are used in combination with at least one additional soluble absorbing dye which absorbs in the red region at longer wavelengths (e.g., 630–750 nm) than the dye of formula (I) in order to provide effective speed control and additional antihalation protection for a red-sensitive emulsion layer. Preferred longer wavelength absorbing soluble dyes which may be used in accordance with such preferred embodiments include, e.g., bis azo dyes of formula (II) and oxonol dyes of formula (III):

(II)

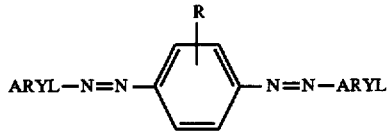

Wherein R represents H or one or more substituent groups or condensed rings and Aryl represents a phenyl or naphthyl group, which may be further substituted or unsubstituted. Such general class of bis azo dyes is known in the art.

(III)

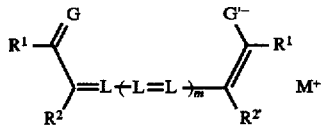

Wherein: G is oxygen, substituted nitrogen, or —C(CN)$_2$; $R^1$, $R^{1'}$, $R^2$, $R^{2'}$ independently represent H or a substituent, or $R^1$ and $R^2$, $R^{1'}$ and $R^{2'}$ may form a ring; m is 2–4; all of the L together define a methine chain, each L representing a methine any of which may be substituted or unsubstituted; and $M^+$ is a cation, such as $H^+$, $Et_3NH^+$, $C_5H_5NH^+$, $Na^+$, $K^+$, and the like. Such general class of oxonol dyes is known in the art, and details as to possible substituents and groups thereof are found, e.g., in U.S. Pat. No. 5,451,494, the disclosure of which is incorporated by reference herein.

Water soluble filter dyes of formulas (II) and (III) further incorporate one or more solubilizing substituent groups such as sulfo (—$SO_3^-$) or sulfato (—$OSO_3^-$) so as to be readily washable out of silver halide emulsion layers upon normal photographic processing. In accordance with a preferred embodiment of the invention, a water soluble oxonol dye of formula (III) above is used wherein at least one L group (preferably the middle L group) of the methine chain is substituted with an acyl substituent of the formula $R^3C(O)$— as disclosed in U.S. Pat. No. 5,451,494, where $R^3$ is an alkyl, aryl, alkyloxy, aryloxy, amino, or heterocycle, any of which may be further substituted or unsubstituted.

Representative longer red wavelength absorbing dyes of formulas (II) and (III) above which may be used in combination with dyes of formula (I) in accordance with the invention include dyes II-1 and III-1 below:

II-1

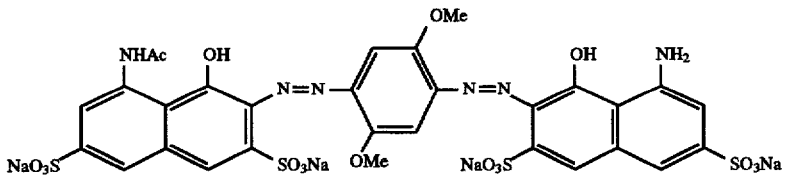

-continued

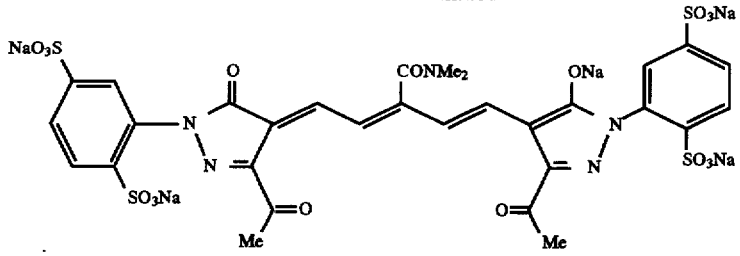

III-1

While absorber dyes may be used at coverages varying over wide ranges to provide varying effects, longer red wavelength absorbing dyes such as those of formulas (II) and (III) (relative to the absorption spectrum of dyes of formula (I)) are preferably used at coverages of from about 5–160 mg/m$^2$, more preferably about 10–100 mg/m$^2$, in order to provide desired red-sensitive layer speed control while being easily removed/decolorized during processing.

The invention is particularly useful with color photographic print elements. In color photographic element printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research Disclosure,* December, 1987, Item 17643, published by Industrial Opportunities Ltd., Homewell Havant, Hampshire, P09 1EF, United Kingdom, and *Research Disclosure,* September 1994, Item 36544, published by Kenneth Mason Publications, Ltd., Emsworth, Hampshire P010 7DQ, England. Materials in which such images are formed can be exposed to an original scene in a camera, or can be duplicates formed from such camera origination materials, such as records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

The photographic element of the invention preferably comprises a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion layers sensitized to the red, green and blue regions of the spectrum. Such materials are described in the Research Disclosure publications cited above. It is within the scope of this invention for the light sensitive material to also be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Diffusible couplers are used in color developer solutions. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described by Edwards et al. in International Publication No. WO 93/012465.

In the following discussion of suitable materials for use in the emulsions and elements that can be used in conjunction with the invention, reference will be made to *Research Disclosure,* September 1994, Item 36544, available as described above, which will be identified hereafter by the term *"Research Disclosure."* The contents of the *Research Disclosure,* including the patents and publications referenced therein, are incorporated herein by reference, and the Sections hereafter referred to are Sections of the *Research Disclosure,* Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure,* February 1995, Item 37038 also may be advantageously used with elements of the invention.

Photographic light-sensitive materials of the invention may utilize silver halide emulsion image forming layers wherein chloride, bromide and iodide are present as a mixture or combination of at least two halides. The combinations significantly influence the performance characteristics of the silver halide emulsion. As explained in Atwell, U.S. Pat. No. 4,269,927, silver halide with a high chloride content possesses a number of highly advantageous characteristics. For example, high chloride silver halides are more soluble than high bromide silver halides, thereby permitting development to be achieved in shorter times. Furthermore, the release of chloride into the developing solution has less restraining action on development compared to bromide and this allows developing solutions to be utilized in a manner that reduces the amount of waste developing solution.

Couplers that may be used in the elements of the invention can be defined as being 4-equivalent or 2-equivalent depending on the the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published application Nos. 1,466,728; 1,531,927; 1,533,039; 2,006,755A and 2,017,704A, the disclosures of which are incorporated herein by reference.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler-Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Typical pyrazoloazole and pyrazolone couplers are represented by the following formulas:

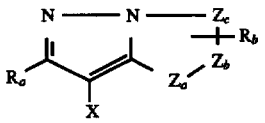

MAGENTA-1

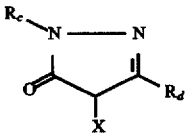

MAGENTA-2 wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =CH—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$. Preferably, a ballast group is incorporated in either $R_a$ or $R_b$ in MAGENTA-1 and in either $R_c$ or $R_d$ in MAGENTA-2.

Couplers that form cyan dyes upon reaction with oxidized color developing agents which may be included in elements of the invention include those which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler-Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

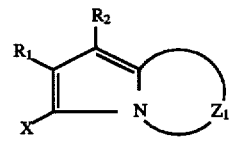

CYAN-2

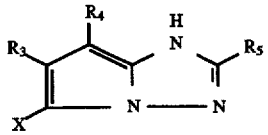

CYAN-3

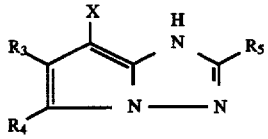

CYAN-4

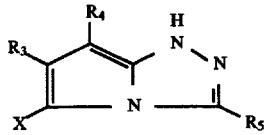

CYAN-5

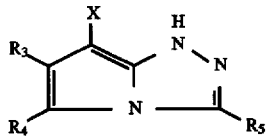

CYAN-6

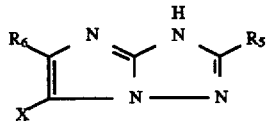

wherein $R_1$ and $R_5$ each represent a hydrogen or a substituent; $R_2$ represents a substituent; $R_3$ and $R_4$ each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —NH—,—CH(R)—, etc., that preferably has a pKa value of from 3 to 12 in water. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

More preferable are cyan couplers of the following formulas:

CYAN-7

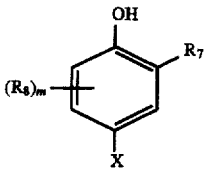

CYAN-8

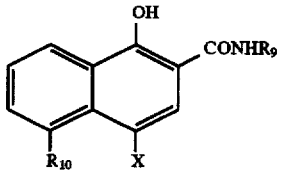

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler-Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

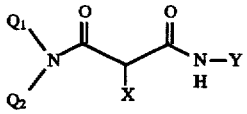

YELLOW-2

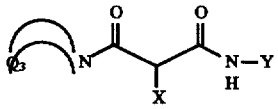

YELLOW-3

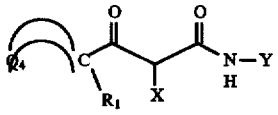

YELLOW-4

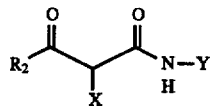

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

To control the migration of various components coated in a photographic layer, including couplers, it is preferable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

Typical examples of photographic substituents include alkyl, aryl, anilino, carbonamido, sulfonamido, alkylthio, arylthio, alkenyl, cycloalkyl, and further to these exemplified are halogen, cycloalkenyl, alkynyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

It may be useful to use a combination of couplers any of which may contain known ballasts or coupling-off groups such as those described in U.S. Pat. Nos. 4,301,235; 4,853,319 and 4,351,897.

If desired, the photographic elements of the invention can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ, ENGLAND.

Preferred supports for elements in accordance with the invention comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate) and poly(ethylene naphthalate). In addition to the specific components and layers described above, the photographic elements of the invention may include further features and layers as are known in the art. Polyester supports, e.g., typically employ undercoat or primer layers to improve adhesion of other layers thereto. Such undercoat layers are well known in the art and comprise, e.g., a vinylidene chloride/methyl acrylate/itaconic acid terpolymer or vinyldene chloride/acrylonitrile/acrylic acid terpolymer as described in U.S. Pat. Nos. 2,627,088; 2,698,235; 2,698,240; 2,943,937; 3,143,421; 3,201,249; 3,271,178; 3,501,301.

In addition to the soluble absorber dyes described above, additional positioned filter dyes may be included in separate antihalation layers in photographic elements in accordance with the invention, preferably in a layer coated between the emulsion layers and the element support. Alternatively, antihalation protection and backside safelight protection may be provided by a layer comprising antihalation dyes or pigments, or a carbon black "rem-jet" layer, coated on the backside of the support opposite to the emulsion layers. Positioned antihalation filter dyes are preferably incorporated into the photographic element in the form of solid particle dispersions which are readily solublized and removed or decolorized upon photographic processing. Preferred filter dyes that can be used in the form of solid particle dispersions include those which are substantially insoluble at aqueous coating pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D-(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxonol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163 and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; 5,266,454; and 5,399,690; the disclosures of each of which are herein incorporated by reference. Such dyes are generally described as being insoluble in aqueous solutions at pH below 7, and readily soluble or decolorizable in aqueous photographic processing solutions at pH 8 or above. Exemplary filter dyes include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above. Specific dyes may be selected so as to provide antihalation and backside safelight exposure protection to desired light wavelengths.

As described above, the soluble absorber dyes used in accordance with the invention are designed to be removed and decolorized during photographic processing. Conventional processing of photographic print elements include the Kodak ECP-2B Process for motion picture print films, described in Kodak Publication No. H-24, Manual For Processing Eastman Color Films, the disclosure of which is hereby incorporated by reference.

The following examples illustrate the preparation of photographic elements in accordance with this invention.

EXAMPLE 1

A photographic element was prepared by coating the following layers on a gelatin subbed polyethylene terephthalate support with rem-jet carbon black containing backing layer (control Element A):

| Element A | |
|---|---|
| Protective Overcoat Layer: | |
| Poly(dimethyl siloxane), 200-CS | 65.9 mg/m². |
| Poly(methyl methacrylate) beads, | 5.0 mg/m². |
| Gelatin, | 977.4 mg/m². |
| Spreading aids. | |
| Gelatin hardener. | |
| Red Sensitized Layer: | |
| AgClBr cubic grain emulsion (25% Br, 0.15 micron), sensitized with red dye RSD-1 (0.1808 mmole/Ag mole), supersensitizer SS-1 (0.6327 mmole/Ag mole), | 397.2 mg/m². |
| AgClBr cubic grain emulsion (25% Br, 0.24 micron), sensitized with red dye RSD-1 (0.1356 mmole/Ag mole), supersensitizer SS-1 (0.7444 mmole/Ag mole), | 44.1 mg/m². |
| Cyan dye forming coupler CC-1, | 968.8 mg/m². |
| Oxidized developer scavenger ODS-1, | 12.9 mg/m². |
| Gelatin, | 2422 mg/m². |
| Spreading aids. | |
| Support: | |
| Transparent polyethylene terephthalate support with rem-jet carbon black pigmented, nongelatin layer on the back of the film base which provides antihalation and antistatic properties. | |

Three more photographic elements (Elements B–D) were prepared similarly to Element A, except that dyes I-1 (Indigo Carmine), I-2 (Potassium Indigotrisulfonate), and I-3 (Potassium Indigotetrasulfonate) in accordance with the invention were added to the protective overcoat layer at 64.6 mg/m². Dye I-1, I-2 and I-3 were purchased from Aldrich Chemical Co. (Milwaukee, Wis.), and purified by recrystallization from water and alcohol mixtures.

A safelight sensitivity test was performed with Elements A–D in the following manner. The elements were exposed for a period of 60 minutes by means of a 3000° K, 1000 W Tungsten EGR light source through a Kodak Safelight Filter No. 8 (illuminance level was 15,000 lux without safelight filter) and a 0–3 neutral density step tablet. The elements were then processed through Process ECP-2B using an accelerator and persulfate bleach as described in Kodak Publication No. H-24 referenced above, with the exception that those steps specific to sound track development were omitted. The optical density due to dye formation was then measured on a densitometer using filters in the densitometer appropriate to the intended use of the photographic element. Dye density was then graphed vs. log(exposure) to form the Red, Green, and Blue D-LogE characteristic curves of the photographic elements. The safelight speed of the elements was calculated by the following equation:

$$\text{Safelight Speed}=100(3-\log E)$$

where E represents the exposure value in lux-sec needed to obtain a 1.0 optical density. Based on this equation, it is readily understood that elements with more negative safelight speed values are less sensitive to safelight exposure than elements with less negative safelight speeds. The safelight speeds for Elements A–D from the safelight sensitivity test are shown in Table I.

TABLE I

| Element | Dye | Dye Laydown (mg/m²) | Safelight Red Speed |
|---|---|---|---|
| A | no dye | — | −18 |
| B | I-1 | 64.6 | −100 |
| C | I-2 | 64.6 | −107 |
| D | I-3 | 64.6 | −70 |

Results from Table I show that Elements B–D containing dyes I-1, I-2 and I-3 in accordance with the invention are less sensitive to safelight exposure than Element A which does not contain a safelight dye.

EXAMPLE 2

Eight cyan monochromes (Elements E–L) were prepared in a manner similar to Element A described in Example 1. Elements E–L differed from Element A only in the composition and/or coverage of the dyes added to the protective overcoat layer as indicated in Table II below. Elements E–L were exposed for 1/300second by means of a 3000° K Tungsten light source through a 0–3 neutral density step tablet, a heat-absorbing filter, and a filter designed to represent a motion picture color negative film. After exposure, the elements were processed through Process ECP-2B using a ferricyanide bleach as described in Kodak Publication No. H-24 referenced above, with the exception that those steps specific to sound track development were omitted. The optical density was measured as described in Example 1. The relative speed at a density of 1.0 (SPD1.0) values are listed in Table II. The relative speed values at a density of 1.0 were determined by interpolation over a 300 unit range corresponding to the exposure range generated by exposure through the 0–3 neutral density step tablet, where the relative speed at the end of the log(exposure) scale representing greatest exposure is assigned a value of 0 and the relative speed at the opposite end of the log(exposure) scale representing least exposure is assigned a value of 300. Absorber dye levels were selected to achieve comparable speed values.

Separate samples of Elements E–L were stored for 48 hours at −17.8° C. (0° F.)/50% relative humidity and at 25.6° C. (78° F.)/80% relative humidity to simulate raw stock keeping conditions under high humidity. The elements were exposed, processed, and the optical density measured as described above. The changes in relative red speed at a density of 1.0 (delta SPD1.0) values for elements E–L stored at 25.6° C. (78° F.)/80% relative humidity relative to the elements stored at −17.8° C. (0° F.)/50% relative humidity are also shown in Table II.

Separate samples of Elements E–L were also subjected to the safelight sensitivity test described in Example 1. The safelight speeds for Elements E–L from the safelight sensitivity test are also shown in Table II.

TABLE II

| Element | Dye(s) | Dye Coverage (mg/m²) | Red SPD1.0 | Incubation Delta Red SDP1.0 | Safelight Red Speed |
|---|---|---|---|---|---|
| E | no dye | — | 169.7 | 0.1 | −22.3 |
| F | D-1 (control) | 102.3 | 113.1 | 19.4 | −95.6 |
| G | D-1 (control) | 110.9 | 108.9 | 22.7 | −101.9 |
| H | D-1 (control) | 119.5 | 106.5 | 26.4 | −105.7 |
| I | III-I | 46.3 | 111.5 | 2.0 | −71.0 |
| J | II-1 | 42.0 | 108.4 | −3.6 | −84.6 |
| K | I-2 + III-1 | 64.6 25.8 | 107.2 | −3.7 | −115.4 |
| L | I-2 + II-1 | 58.1 24.8 | 104.6 | −7.0 | −121.7 |

Results in Table II clearly show that the combination of an absorber dye in accordance with the invention with deeper (longer wavelength absorbing) red dyes III-1 (lambda max 704 nm) and II-1 (lambda max 674 nm) in Elements K and L) provides equivalent or better safelight sensitivity than the wide red absorbing control filter dye D-1 (Elements F–H) without adversely affecting the fresh relative red speed. Furthermore, the same Elements K and L clearly display an advantage in red speed keeping properties under high humidity conditions relative to the Elements F–H containing control filter dye D-1. Further, it is noted that desired safelight and red speed properties are obtained in Elements K and L with advantageously lower overall absorber dye levels relative to Elements F–H.

EXAMPLE 3

A multilayer element is prepared using a coating melt prepared as follows. Solid particle dispersions of yellow filter dye YFD-1, cyan filter dye CFD-1, and cyan filter dye CFD-2 are made by milling. The three dispersions are added to a mixture of deionized gelatin, polystyrene sulfonic acid sodium salt (a thickener) and spreading aids, and then coated on a transparent support in a multilayer structure (Element M). The support is a polyethylene terephthalate base which is subbed on both sides. An aqueous antistatic layer comprising vanadium pentoxide silver-doped at 8%, a terpolymer latex of acrylonitrile, vinylidene chloride, and acrylic acid, and coating aids are applied to the side opposite the emulsion side. On top of the antistatic layer is applied an overcoat comprising Witcobond™ W232 (Witco) polyurethane, Neocryl™ CX-100 crosslinker (Zeneca), (poly)methyl methacrylate beads, and coating aids.

| Element M | |
|---|---|
| Protective Overcoat Layer: | |
| Poly(dimethyl siloxane) 200-CS, | 65.9 mg/m². |
| Poly(methyl methacrylate) beads, | 5.3 mg/m². |
| Gelatin, | 976.3 g/m². |
| Spreading aids. | |
| Green Sensitized Layer: | |
| AgClBr cubic grain emulsion (25% Br, 0.15 micron), spectrally sensitized with green dye GSD-1 (0.5273 mmole/Ag mole), supersensitizer SS-1 (1.1212 mmole/Ag mole), | 312.2 mg/m². |
| AgClBr cubic grain emulsion (25% Br, 0.15 micron), spectrally sensitized with green dye GSD-1 (0.5273 mmole/Ag mole), supersensitizer SS-1 (1.1770 mmole/Ag mole), | 121.6 mg/m². |
| AgClBr cubic grain emulsion (25% Br, 0.24 micron), spectrally sensitized with green dye GSD-1 (0.4785 mmole/Ag mole), supersensitizer SS-1 (1.3902 mmole/Ag mole), | 39.8 mg/m². |
| Magenta dye forming coupler MC-1, | 699.7 mg/m². |
| Oxidized developer scavenger ODS-1, | 56.5 mg/m². |

-continued

| Element M | |
|---|---|
| Soluble green filter dye GD-1, | 40.0 mg/m². |
| Soluble green filter dye GD-2, | 58.6 mg/m². |
| Gelatin, | 2077 mg/m². |
| Interlayer: 1 | |
| Oxidized developer scavenger ODS-1, | 79.1 mg/m². |
| Gelatin, | 610.3 mg/m². |
| Spreading aids. | |
| Red Sensitized Layer: | |
| AgClBr cubic grain emulsion (25% Br, 0.15 micron), spectrally sensitized with red dye RSD-1 (0.1808 mmole/Ag mole), supersensitizer SS-1 (0.6327 mmole/Ag mole), | 398.3 mg/m². |
| AgClBr cubic grain emulsion (25% Br, 0.24 micron), spectrally sensitized with red dye RSD-1 (0.1356 mmole/Ag mole), supersensitizer SS-1 (0.7444 mmole/Ag mole), | 32.3 mg/m². |
| Cyan dye forming coupler CC-1, | 968.8 mg/m². |
| Oxidized developer scavenger ODS-1, | 26.0 mg/m². |
| Soluble filter dye I-2, | 64.6 mg/m². |
| Soluble filter dye III-1, | 25.8 mg/m². |
| Palladium compound PC-1, | 8.0 mg/m². |
| Gelatin, | 3453 mg/m². |
| Gelatin hardener. | |
| Interlayer: | |
| Oxidized developer scavenger ODS-1, | 79.1 mg/m². |
| Gelatin, | 610.3 mg/m². |
| Spreading aids. | |
| Blue Sensitized Layer: | |
| AgCl cubic grain emulsion (0.58 micron), spectrally sensitized with blue dye BSD-1 (0.3336 mmole/Ag mole), | 671.7 mg/m². |
| AgCl cubic grain emulsion (0.76 micron), spectrally sensitized with blue dye BSD-1 (0.2669 mmole/Ag mole), | 223.9 mg/m². |
| Yellow dye forming coupler YC-1, | 1883.7 mg/m². |

-continued

| Element M | |
|---|---|
| Yellow dye YD-1, | 22.0 mg/m². |
| Soluble blue filter dye BD-1, | 32.6 mg/m². |
| Sequestrant SQ-1, | 322.9 mg/m². |
| Sequestrant SQ-2, | 35.5 mg/m². |
| Ultraviolet absorber UV-1, | 322.9 mg/m². |
| Gelatin, | 3980 mg/m². |
| Antihalation Layer: | |
| Yellow filter dye YFD-1, | 32.3 mg/². |
| Cyan filter dye CFD-1, | 53.8 mg/m². |
| Cyan filter dye CFD-2, | 107.6 mg/m². |
| Polystyrene sulfonic acid sodium salt, | 12.9 mg/m². |
| Deionized gelatin, | 758.9 mg/m². |
| Spreading aids. | |
| Support: | |
| 4.0 micron polyethylene terephthalate base subbed with a terpolymer latex of methyl acrylate, vinylidene chloride and itaconic acid, coated with an antistat layer comprising 4.3 mg/m² vanadium pentoxide silver-doped at 8%, 4.3 mg/m² of a terpolymer latex of acrylonitrile, vinylidene chloride, and acrylic acid, and 3.2 mg/m² of coating aid Triton ™ X100, and overcoated with a barrier layer comprising 1233 mg/m² of Witcobond ™ W232, 74.0 mg/m² of Neocryl ™ CX-100 crosslinker, 26.9 mg/m² of (poly)methyl methacrylate beads, 39.5 mg/m² of Triton ™ X100, and 1.1 mg/m² of Michemlube-160 ™. | |

Element M is exposed and processed as described in Example 2. The results are judged to be suitable for the intended use of such an element in the photographic industry.

The following structures represent compounds utilized in the above photographic elements not previously identified.

GSD-1

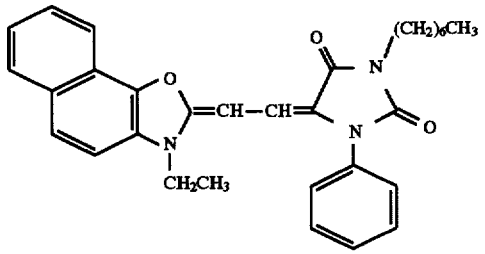

SS-1

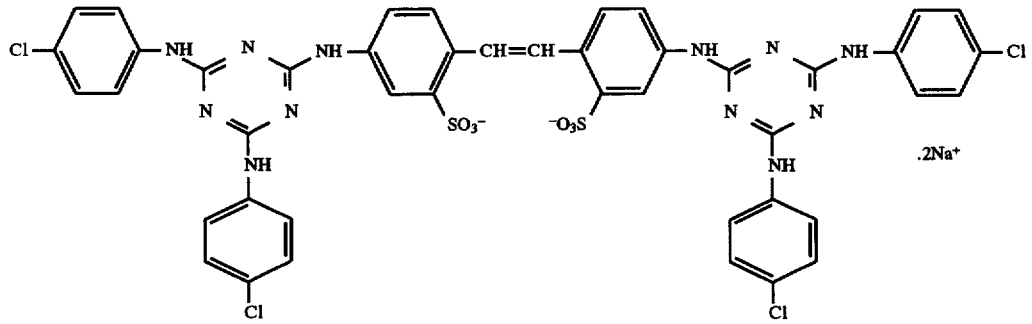

-continued
MC-1
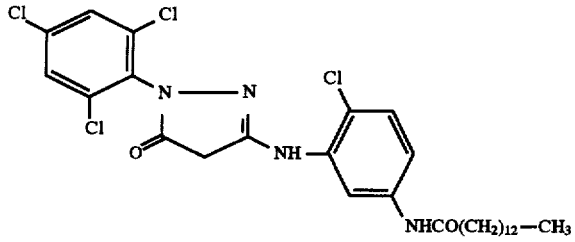
ODS-1
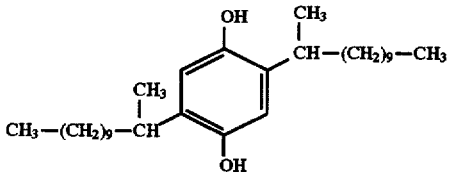
GD-1
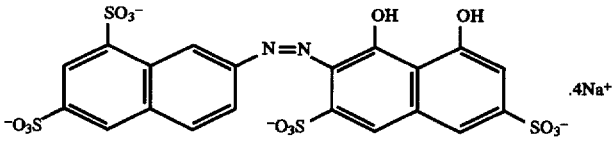
GD-2
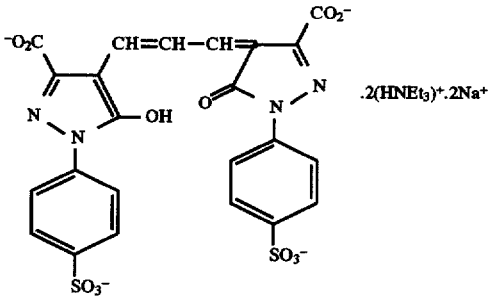
RSD-1
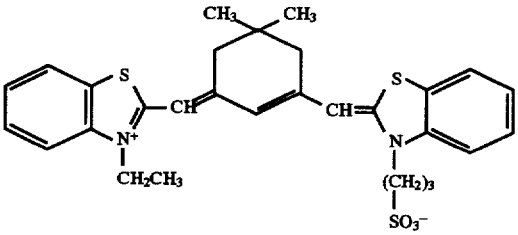
CC-1
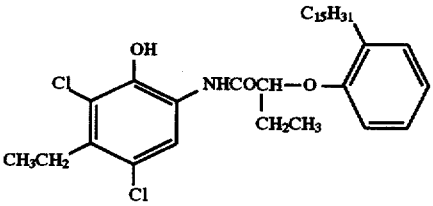
YFD-1
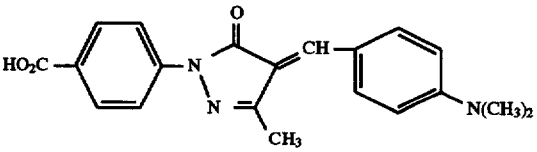

-continued
CFD-1
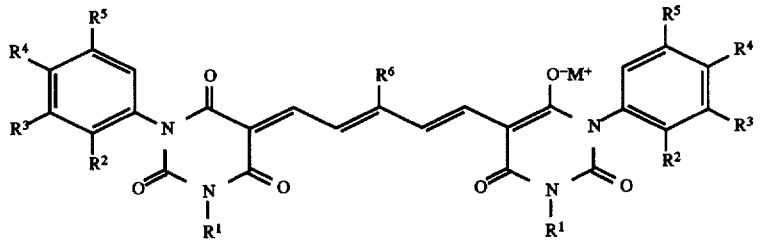
$R^1$, $R^2$, $R^3$, $R^5$, $R^6$ each represents H, $R^4$ represents OH, and $M^+$ is triethylammonium
CFD-2
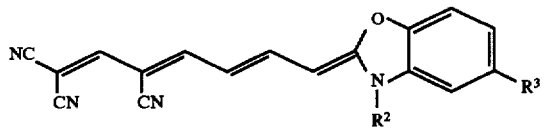
$R^1$ and $R^3$ represent $NHSO_2CH_3$, $R^2$ represents $CH_3$
PC-1
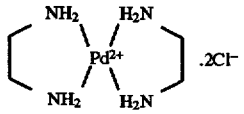
BSD-1
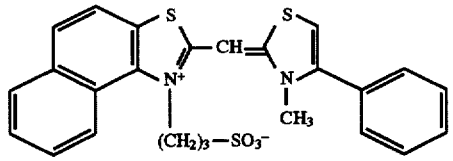
YC-1
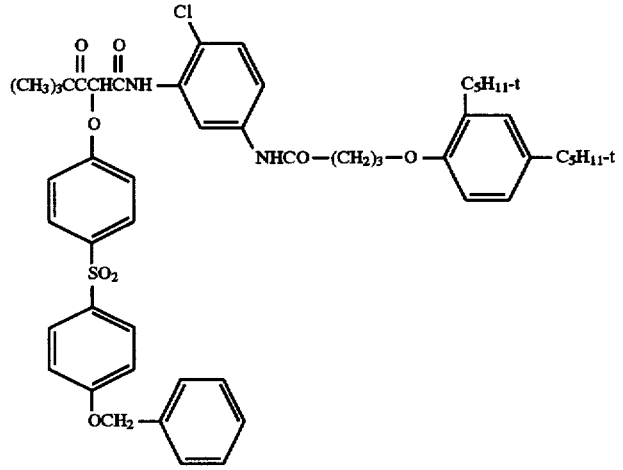
YD-1
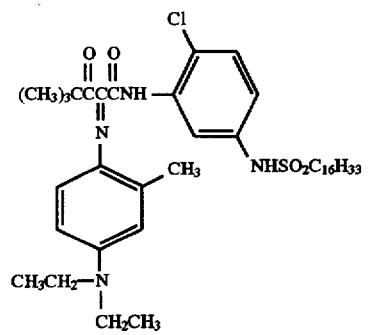

-continued

BD-1

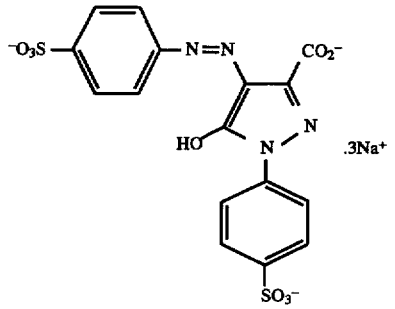

SQ-1

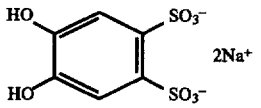

SQ-2

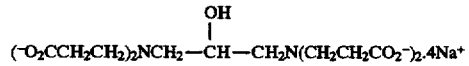

UV-1

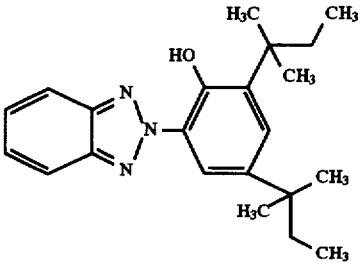

This invention has been described in detail with particular reference to preferred embodiments thereof. It will be understood that variations and modifications can be made within the spirit and scope of the invention.

We claim:

1. A silver halide light sensitive photographic element comprising a support bearing on one side thereof at least one light-sensitive silver halide emulsion layer, wherein the emulsion layer or a separate hydrophilic colloid layer of the element comprises a soluble absorber dye of the following formula (I):

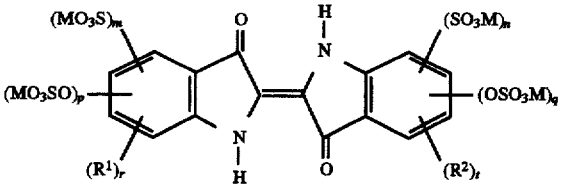

(I)

wherein each M is H or a counterion; each $R^1$ and $R^2$ independently represents H or a photographically acceptable substituent; m+p equals from 1 to 4; n+q equals from 1 to 4; and each of r and t represents from 0 to 3.

2. An element according to claim 1, wherein said at least one light-sensitive silver halide emulsion layer comprises at least one red-sensitive silver halide emulsion layer.

3. An element according to claim 2, wherein the dye of formula (I) is coated in a layer on the same side of the support as the red-sensitive emulsion layer.

4. An element according to claim 2, wherein the support bears on the same side thereof at least one blue-sensitive silver halide emulsion yellow-image forming layer, at least one red-sensitive silver halide emulsion cyan-image forming layer, and at least one green-sensitive silver halide emulsion magenta-image forming layer.

5. An element according to claim 4, wherein the dye of formula (I) is coated in a layer on the same side of the support as the emulsion layers.

6. An element according to claim 1, wherein m+n+p+q equals from 2 to 6.

7. An element according to claim 1, wherein m+n+p+q equals from 2 to 4.

8. An element according to claim 1, wherein m+n+p+q equals 3.

9. An element according to claim 1, wherein the dye of formula (I) is incorporated into hydrophilic colloid layers of the element at total coverages of from about 10–250 mg/m$^2$.

10. An element according to claim 9, wherein the dye of formula (I) is incorporated into hydrophilic colloid layers of the element at total coverages of from about 20–130 mg/m$^2$.

11. An element according to claim 1, wherein the at least one light-sensitive emulsion layer comprises at least one red-sensitive silver halide emulsion layer, further comprising at least one additional soluble absorbing dye which absorbs in the red region at longer wavelengths than the dye of formula (I).

12. An element according to claim 11, wherein the longer wavelength absorbing dye comprises a bis azo or an oxonol dye.

13. An element according to claim 11, wherein the longer wavelength absorbing dye is incorporated into hydrophilic colloid layers of the element at total coverages of from about 5–160 mg/m$^2$.

14. An element according to claim 11, wherein the longer wavelength absorbing dye is incorporated into hydrophilic colloid layers of the element at total coverages of from about 10–100 mg/m$^2$.

* * * * *